US009272506B2

(12) United States Patent
Stowe et al.

(10) Patent No.: US 9,272,506 B2
(45) Date of Patent: Mar. 1, 2016

(54) SYSTEMS AND METHODS FOR IMPLEMENTING AN ADVANCED INKER UNIT SURFACE CONDITIONING SYSTEM IN A VARIABLE DATA DIGITAL LITHOGRAPHIC PRINTING DEVICE

(71) Applicant: Palo Alto Research Center Incorporated, Palo Alto, CA (US)

(72) Inventors: Timothy D Stowe, Alameda, CA (US); David K. Biegelsen, Portola Valley, CA (US); Gregory B Anderson, Emerald Hills, CA (US); Jack T. Lestrange, Macedon, NY (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 14/318,654

(22) Filed: Jun. 29, 2014

(65) Prior Publication Data

US 2015/0375497 A1 Dec. 31, 2015

(51) Int. Cl.
*B41F 35/04* (2006.01)
*B41F 7/24* (2006.01)

(52) U.S. Cl.
CPC .. *B41F 35/04* (2013.01); *B41F 7/24* (2013.01)

(58) Field of Classification Search
CPC ..... B41F 35/04; B41F 9/1018; B41F 9/14; B41F 9/16; B41F 35/02; B41F 35/06; B08B 1/001; B08B 1/002; B08B 1/006
See application file for complete search history.

(56) References Cited

U.S. PATENT DOCUMENTS

| | | | | | |
|---|---|---|---|---|---|
| 4,793,041 | A * | 12/1988 | Jenkins et al. | ..... | 492/37 |
| 5,086,701 | A * | 2/1992 | Gasparrini et al. | ..... | 101/425 |
| 5,245,925 | A * | 9/1993 | Switall et al. | ..... | 101/425 |
| 5,740,739 | A * | 4/1998 | Herold et al. | ..... | 101/425 |
| 6,568,326 | B1 * | 5/2003 | Corrado et al. | ..... | 101/483 |
| 2003/0046785 | A1 * | 3/2003 | Shiroki et al. | ..... | 15/256.52 |
| 2009/0056741 | A1 * | 3/2009 | Iida et al. | ..... | B41F 35/02 134/1 |
| 2012/0103212 | A1 | 5/2012 | Stowe et al. | | |

(Continued)

FOREIGN PATENT DOCUMENTS

| | | | | | |
|---|---|---|---|---|---|
| JP | 2001341286 | A * | 12/2001 | ..... | B41F 35/04 |
| JP | 2006175858 | A * | 7/2006 | ..... | B41F 35/04 |

(Continued)

*Primary Examiner* — Jennifer Simmons
*Assistant Examiner* — Ruben Parco, Jr.
(74) *Attorney, Agent, or Firm* — Ronald E. Prass, Jr.; Prass LLP

(57) ABSTRACT

A system and method are provided for providing an improved inker unit surface cleaning and conditioning system, including in a single anilox chamber blade system, for improving image quality, including eliminating ghosting, in a proposed variable data digital lithographic image forming architecture. Techniques are provided to remove acquired oil from an inking member. A particularly-configured containment encloses a cleaner (disturber) roller to emulsify the acquired oil on the inking roller. The cleaner roller is preferably configured with a pliable surface including a silicon roller surface over a porous base. The silicon roller (1) absorbs dampening solution oil; and (2) agitates ink that may be still held in certain cells/cavities of the inking member or roller. In embodiments, a vacuum pressure is applied to the inside of the hollow cleaner roller to better remove the residual ink and dampening solution from the inking roller.

17 Claims, 3 Drawing Sheets

(56) References Cited

U.S. PATENT DOCUMENTS

2012/0291642 A1 11/2012 Barton
2013/0032050 A1* 2/2013 Pattekar et al. ..... 101/148

FOREIGN PATENT DOCUMENTS

JP 2010207656 A * 9/2010 ..... B08B 5/04
JP 2011240297 A * 12/2011 ..... B08B 1/04

* cited by examiner

SYSTEMS AND METHODS FOR IMPLEMENTING AN ADVANCED INKER UNIT SURFACE CONDITIONING SYSTEM IN A VARIABLE DATA DIGITAL LITHOGRAPHIC PRINTING DEVICE

BACKGROUND

1. Field of Disclosed Subject Matter

This disclosure relates to systems and methods for providing an improved inker unit surface cleaning and conditioning system, including in a single anilox chamber blade system, for improving image quality, including eliminating ghosting, in a proposed variable data digital lithographic image forming architecture.

2. Related Art

U.S. Patent Application Publication No. 2012/0103212 A1 (the 212 Publication) published May 3, 2012 and based on U.S. patent application Ser. No. 13/095,714, which is commonly assigned and the disclosure of which is incorporated by reference herein in its entirety, proposes systems and methods for providing variable data lithographic and offset lithographic printing or image receiving medium marking in image forming system. The systems and methods disclosed in the 212 Publication are directed to improvements on various aspects of previously-attempted variable data imaging lithographic marking concepts to achieve effective truly variable digital data lithographic printing.

According to the 212 Publication, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 212 Publication describes, in requisite detail, an exemplary variable data lithography system 100 such as that shown, for example, in FIG. 1. A general description of the exemplary system 100 shown in FIG. 1 is provided here. Additional details regarding individual components and/or subsystems shown in the exemplary system 100 of FIG. 1 may be found in the 212 Publication.

As shown in FIG. 1, the exemplary system 100 may include an imaging member 110. The imaging member 110 in the embodiment shown in FIG. 1 is a drum, but this exemplary depiction should not be read in a manner that precludes the imaging member 110 being a plate or a belt, or of another known configuration. The imaging member 110 is used to apply an inked image to an image receiving media substrate 114 at a transfer nip 112. The transfer nip 112 is produced by an impression roller 118, as part of an image transfer mechanism 160, exerting pressure in the direction of the imaging member 110. The exemplary system 100 may be used for producing images on a wide variety of image receiving media substrates 114. The 212 Publication also explains the wide latitude of marking (printing) materials that may be used, including marking materials with pigment densities greater than 10% by weight. As does the 212 Publication, this disclosure will use the term ink to refer to a broad range of printing or marking materials to include those which are commonly understood to be inks, pigments, and other materials which may be applied by the exemplary system 100 to produce an output image on the image receiving media substrate 114.

The 212 Publication depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening solution subsystem 120 generally comprising a series of rollers, which may be considered as dampening rollers or a dampening unit, for uniformly wetting the reimageable surface of the imaging member 110 with dampening solution. A purpose of the dampening solution subsystem 120 is to deliver a layer of dampening solution, generally having a uniform and controlled thickness, to the reimageable surface of the imaging member 110.

Once the dampening solution is metered onto the reimageable surface of the imaging member 110, a thickness of the dampening solution may be measured using a sensor 125 that may provide feedback to control the metering of the dampening solution onto the reimageable surface of the imaging member 110 by the dampening solution subsystem 120.

Once a precise and uniform amount of dampening solution is provided by the dampening solution subsystem 120 on the reimageable surface of the imaging member 110, and optical patterning subsystem 130 may be used to selectively form a latent image in the uniform dampening solution layer by image-wise patterning the dampening solution layer using, for example, laser energy. The reimageable surface of the imaging member 110 should ideally absorb most of the laser energy emitted from the optical patterning subsystem 130 close to the surface to minimize energy wasted in heating the dampening solution and to minimize lateral spreading of heat in order to maintain a high spatial resolution capability. While the optical patterning subsystem 130 is described above as being a laser emitter, it should be understood that a variety of different systems may be used to deliver the optical energy to pattern the dampening solution.

The mechanics at work in the patterning process undertaken by the optical patterning subsystem 130 of the exemplary system 100 are described in detail with reference to FIG. 5 in the 212 Publication. Briefly, the application of optical patterning energy from the optical patterning subsystem 130 results in selective evaporation of portions of the layer of dampening solution.

Following patterning of the dampening solution layer by the optical patterning subsystem 130, the patterned layer over the reimageable surface of the imaging member 110 is presented to an inker subsystem 140. The inker subsystem 140 is used to apply a uniform layer of ink over the layer of dampening solution and the reimageable surface layer of the imaging member 110. The inker subsystem 140 may use an anilox roller to meter an ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink deposited on the unformatted portions of the dampening solution will not adhere based on the hydrophobic and/or oleophobic nature of those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a transfer nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening solution may also wet substrate 114, the volume of such a dampening solution will be minimal, and will rapidly evaporate or be absorbed by the substrate 114.

SUMMARY OF DISCLOSED EMBODIMENTS

In variable data lithography, it is desirable to use an anilox chamber blade system as the inker subsystem. The reason for this is that the pass consumption history of ink imaging is entirely controllable by using an anilox roller and a doctor blade. One each pass of the anilox roller ink that is not used up from individual cells in the surface of the anilox roller gets refilled by new ink being deposited in the cells.

U.S. Patent Application Publication No. 2012/0291642 A1 (the 642 Publication), which is commonly assigned, describes the use of a single roller anilox system for a variable data digital lithographic image forming system. The 642 Publication inking system is described as being effective in reducing ghosting issues Ink is transferred from an ink chamber onto an inking member, the inking member including ink cells in its surface for containing the transferred ink. The ink is leveled on a surface of the inking member by applying a doctor blade to the surface of the inking member, the doctor blade being configured to remove excess ink from the inking member surface, and/or to level the ink in the cells in the surface of the inking member Ink is transferred directly from the anilox roller to a reimageable surface of an imaging member to ink the image produced thereon.

Simply, the inking system may include an ink chamber, the inking member, and the ink chamber doctor blade configured to remove excess ink from the inking member. The ink chamber may be configured to deposit the ink on the surface of the inking member. The inking member may be configured to include one or more cells or grooves for holding ink deposited by the ink chamber. The inking member may be, for example, an anilox roller. The ink cells may be one of a tri-helical or quad-channel type arranged about a surface of the roller. Actually, the ink cells may be configured to have any shape that is suitable for carrying ink from the ink chamber to the reimageable surface of the imaging member for transfer thereto.

The 642 Publication addresses difficulties arising from a coincident back transfer of an amount of the dampening solution on the reimageable surface to the inking member. In the 642 Publication, two methods are indicated for removing the dampening solution from the inking member, e.g., using (1) a doctor blade and/or (2) an air knife. However, these methods are not completely effective under certain conditions. First, whether a doctor blade or an air knife is used, the 642 Publication methods tend to waste ink as they do little to agitate stale ink in the cells. Second, it may be difficult to remove the dampening solution with a layer thickness ~0.1 um using the doctor blade, without scraping off ink as well, leading to excess ink waste and increasing costs. Third, the air knife approach, while effective in reducing the dampening solution, may not be desirable in terms of efficient use of the dampening solution. For example, the air knife may result in increasing humidity in a room over time if a water based dampening solution is used. If a non-water based dampening solution is used, it may desirable to recycle the dampening solution material in a closed-loop system for reducing run costs or to remove it from the air with high efficiency. While the air knife could blow and funnel air toward a collection point, the resulting vapor will have a partial pressure of dampening solution which is quite low, resulting in low collection and recycling efficiencies. In addition, the air knife may not disturb the layer enough to completely remove all of the dampening solution and may not effectively emulsify any residue.

Unused ink that sits dormant in the cells in the surface of the inking member may give rise to different visco-elastic properties of the ink over time in relation ink which is free-flowing through the ink chamber.

As discussed above regarding the 642 Publication, it is known that some of the dampening solution used to generate an inked image pattern by rejecting the ink splits upon pressure contact with the ink. Thus, some of the dampening solution builds up in the inking unit over time. If this excess dampening solution does not properly emulsify into the ink then it can lead to image ghosting as it can further act as an ink rejection layer over an the reimageable surface. Under steady state running conditions, some small equilibrium amount of dampening solution (typically <5%) may emulsify into the ink, the exact amount being reflective of the amount of print area coverage for a certain color. When the thin splitting layer of dampening solution does not emulsify, it acts as a blocking layer and can lead to image ghosting.

In waterless offset printing, the above complication is no issue as no dampening solution is used, but the ink does incorporate silicone oil which penetrates the reimageable surface acting as a weak fluid boundary layer. Thus, this liftoff oil is pre-emulsified within the ink already at an equilibrium level.

In traditional offset lithographic printing, a number of distributor rollers are used in the ink train. The effect of the ink splitting naturally allows for a small amount of dampening solution to mechanically emulsify in the ink.

It would be advantageous in view of the above issues to provide a technique by which to more effectively remove acquired oil from the inking member/roller and/or to agitate stale residual ink in cells in the surface of the inking member/roller.

Exemplary embodiments of the disclosed systems and methods may provide a particularly configured containment for the inking (anilox) roller. The particularly-configured containment may include a disturber roller component in place of the doctor blade or the air knife solutions described in the 642 Publication.

Exemplary embodiments may employ the particularly configured containment with the enclosed disturber roller to emulsify the acquired oil on the inking roller.

In embodiments, the disturber roller may preferably be configured to include a pliable surface including, for example, a silicon roller with a porous base. The silicon roller may do two things: (1) absorb the dampening solution oil; and (2) take the ink that may be still held in certain cells/cavities of the inking (anilox) roller, and pull that ink out of those cells/cavities or at least agitate the stale ink in those cells thereby disturbing it so that new (fresh) ink is free to flow into those cells/cavities.

In embodiments, any history of ink remaining on the inking roller and any acquired oil on the inking roller may be removed from the inking roller.

In embodiments, a vacuum pressure may be applied to the inside of a hollow disturber roller to better remove the residual ink and dampening solution from the inking roller prior to new ink being applied to the inking roller for transfer to the reimageable surface of the imaging member.

Exemplary embodiments may result in improved image quality and coincidentally increased customer satisfaction.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for providing an improved inker unit surface cleaning and conditioning system, including in a single anilox chamber blade system, for improving image quality, including eliminating ghosting, in a proposed variable data digital lithographic image forming architecture will be described, in detail, with reference to the following drawings, in which.

DETAILED DESCRIPTION OF THE DISCLOSED EMBODIMENTS

The systems and methods for providing an improved inker unit surface cleaning and conditioning system, including in a single anilox chamber blade system, for improving image quality, including eliminating ghosting, in a proposed variable data digital lithographic image forming architecture according to this disclosure will generally refer to this specific utility or function for those systems and methods. Exemplary embodiments described and depicted in this disclosure should not be interpreted as being specifically limited to any particular configuration of the described inking system. Any advantageous adaptation of a digital image forming process that may benefit from implementation of a cleaning and/or conditioning process for a surface of an inking (anilox) member/roller is contemplated as being included in this disclosure.

Specific reference to, for example, lithographic printing techniques, and to the proposed variable data digital lithographic image forming device should not be considered as being limited to any particular configuration of the techniques or devices, as described. The terms "image forming device," "offset lithographic printing device/system," "offset lithographic marking device/system" and the like, as referenced throughout this disclosure, are intended to refer globally to a class of devices and systems that carry out what are generally understood as lithographic marking functions as those functions would be familiar to those of skill in the art. Additionally, while references will generally be made to individual inking system components, these references are intended to be exemplary only and not limiting to the disclosed subject matter.

Figure 1:
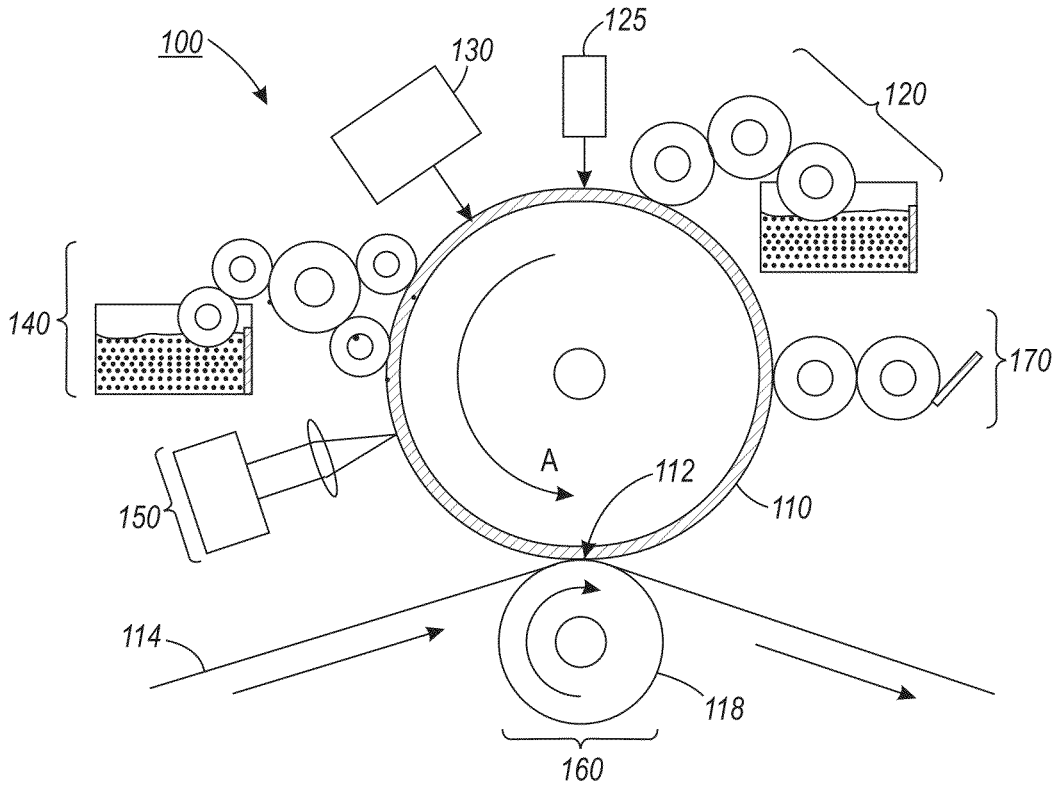
FIG. 1 Related Art
FIG. 1 illustrates a schematic representation of a proposed variable data digital lithographic image forming system.
Figure 2:
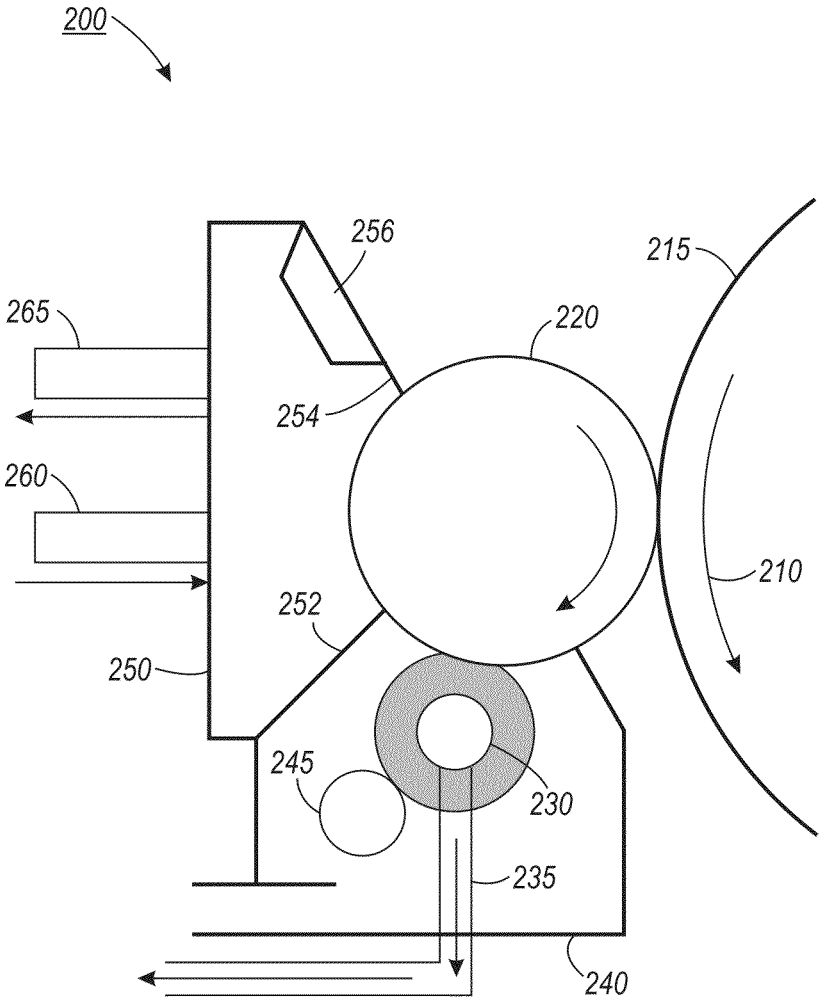
FIG. 2 illustrates a schematic representation of an exemplary embodiment of an improved inker unit including an advanced surface cleaning and conditioning system for a single anilox chamber blade system improving image quality in a proposed variable data digital lithographic image forming architecture according to this disclosure.

FIG. 2 illustrates a schematic representation of an exemplary embodiment of an improved inker unit 200 including an advanced surface cleaning and conditioning system for a single anilox chamber blade system improving image quality in a proposed variable data digital lithographic image forming architecture according to this disclosure. Comparing the orientations of the depiction of the inker unit in FIG. 2 and the depiction of the inker subsystem 140 in FIG. 1 will inform those of skill in the art that no particular orientation of the particular inking elements should be implied from these depictions.

The exemplary improved inker unit 200 may include an anilox inker roller 220 that contacts a reimageable surface 215 of an imaging member 210 to deposit a consistent layer of ink on the digital image formed on the reimageable 215. The anilox inker roller 220 may obtain the ink on its surface and into the cells on its surface from an ink chamber 250 in which ink is provided to the ink chamber 250 through an input port 260 and is exhausted from the ink chamber 250 through an exit port 265. The ink chamber 250 may include at least one wiper containment blade 252 for wiping a surface of the anilox inker roller 220 as it enters the ink chamber 250. The ink chamber 250 may also include at least one doctor blade 254, which may be supported by some manner of blade stiffening attachment 256, the doctor blade 254 being used to level the ink on the surface of the anilox inker roller 220 and in the cells on the surface of the anilox inker roller 220 at an exit of the ink chamber 250.

A disturber roller 230 may be provided in a separate chamber 240 associated with the improved inker unit 200. The disturber roller 230 may be brought into conformal contact with the surface of the anilox inker roller 220 with an objective of disturbing the ink inside each of the cells in the surface of the anilox inker roller 220 on every single pass. The disturber roller 230 may be configured with a very low durometer silicone roller surface that may be capable of pushing lightly into each of the cells in the surface of the anilox inker roller 220. This interaction between the conformal surface of the disturber roller 230 and the surface of, and cells in the surface of, the anilox inker roller 220 may cause old (residual) ink in the cells in the surface of the anilox inker roller 220 to be mixed with new fresh ink delivered to the surface of the anilox inker roller 220 as it passes through the inside the ink chamber 250. The interaction between the conformal surface of the disturber roller 230 and at least the cells in the surface of the anilox inker roller 220 may disturb the ink layer present within each of the cells. Thus, each cell in the surface of the anilox inker roller 220 may be partially refilled with fresh ink on each and every pass. This action may provide significant improvement over conventional systems in which some of the cells in the surface of an anilox inker roller 220 had no new ink flow into them for extended periods of time, or through numerous inking cycles.

Also, the action of the disturber roller 230 may result in removal of back transferred dampening solution through mechanical emulsification in instances where the dampening solution may not be removed from the surface of the anilox inker roller 220 by other mechanical means. This action of the disturber roller 230 may further promote the flow of fresh ink into cells in the surface of the anilox inker roller 220 that may have been otherwise disadvantageously covered by a layer of the dampening solution The disclosed schemes, instead of blowing dampening solution off of the surface of the anilox inker roller 220 may provide a vacuum system including, for example, a vacuum knife placed very close to the ink roller/disturber roller surfaces at a high pressure point. A small draw air draw leading to air flow that is much more highly saturated with dampening solution vapor for much lower air flows than with an air knife arrangement. Further, the disturber roller action may also entrap air within the anilox inker roller/disturber roller nip, leading to much more effective mixing of the residual dampening solution into the air. The conformable silicone rubber roller may, in embodiments, be permeable to some types of dampening solution, such as dampening solution based upon silicone oil. Using a machinable porous metal roller base form with a hollowed core, it may be possible to extract dampening solution vapor which soaks into the disturber roller 230. If an end cap of the disturber roller 230 is sealed, very little air flow needs to be pulled via one or more vacuum paths 235 and much higher vapor partial pressures can be extracted and more easily recycled.

The exemplary improved inker unit 200 may include a side distributor roller 245 that may be used to mix ink in this direction. Such distributor (or metering) rollers are often used in a traditional offset inker train. This distributor roller 245 may be used to effectively mix ink in a direction orthogonal to the anilox inker roller surface motion.

The exemplary improved inking system 200 may provide improvements in a non-ghosting single pass anilox inking design for variable data digital lithographic image forming techniques and architecture to aid in allowing new ink to flow into unused anilox cells by disturbing the residual ink layer and emulsifying any trapped dampening solution. In addition, the geometry shown in FIG. 2 may aid in extracting volatile dampening solution vapors at a much higher vapor pressure, leading to much more efficient vapor extraction and/or recycling.

Figure 3:
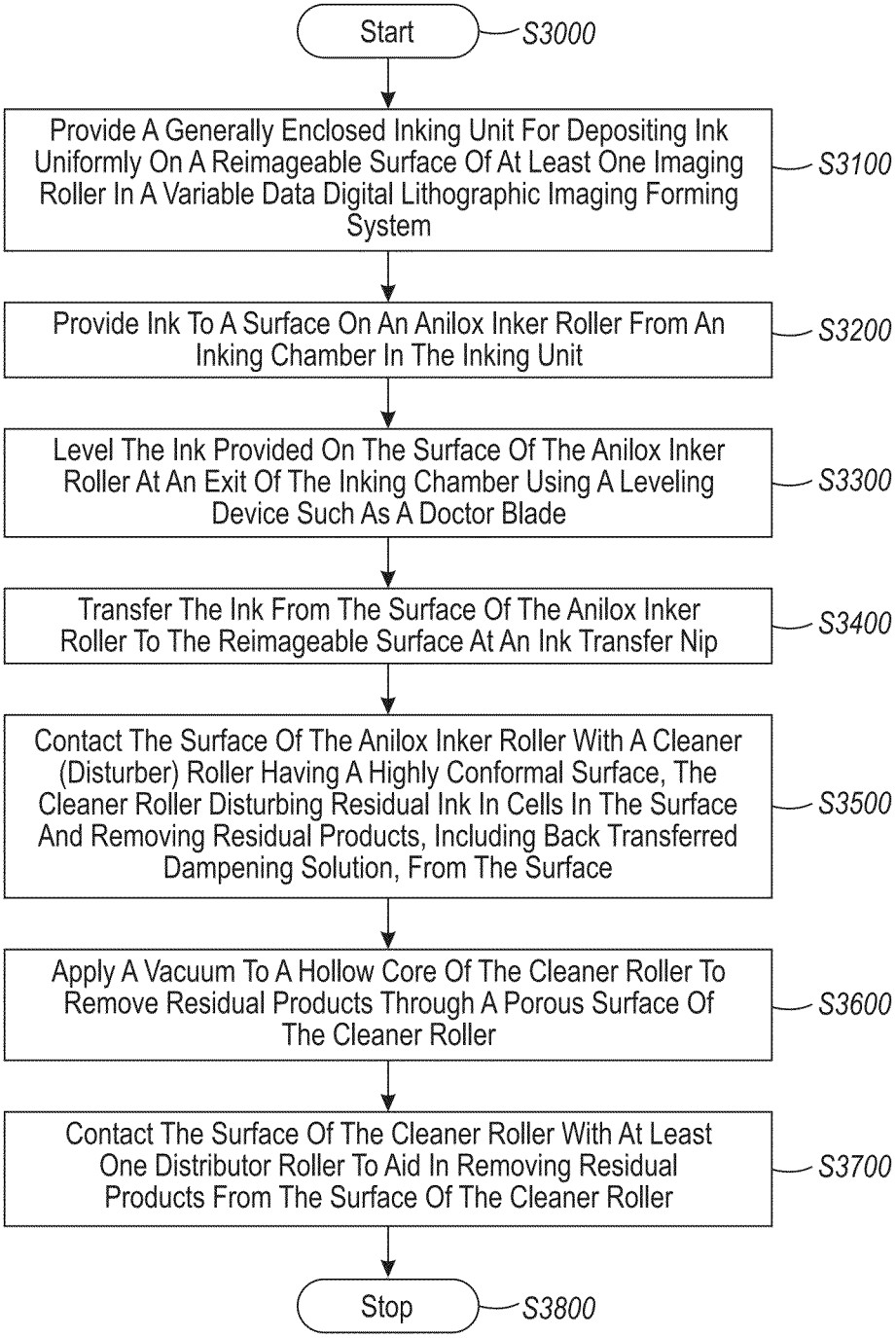
FIG. 3 illustrates a flowchart of an exemplary method for implementing improved surface cleaning and conditioning for an inking member in a proposed variable data digital lithographic image forming architecture according to this disclosure.

The disclosed embodiments may include an exemplary method for implementing improved surface conditioning for an inking member in a proposed variable data digital lithographic image forming system. FIG. 3 illustrates a flowchart of such an exemplary method. As shown in FIG. 3, operation of the method commences at Step S3000 and proceeds to Step S3100.

In Step S3100, a generally enclosed inking unit for depositing ink uniformly on a reimageable surface of at least one imaging roller in a variable digital data lithographic image forming system may be provided. Operation of the method proceeds to Step S3200.

In Step S3200, ink may be provided from an inking chamber in the inking unit to a surface of an inker roller, including an anilox inker roller. Operation of the method proceeds to Step S3300.

In Step S3300, the ink provided on the surface of the inker roller may be leveled at an exit of the inking chamber using a layer leveling device. The layer leveling device may be, for example, a doctor blade. Operation of the method proceeds to Step S3400.

In Step S3400, the ink may be transferred from the surface of the inker roller to the reimageable surface at an ink transfer nip. Operation of the method proceeds to Step S3500.

In Step S3500, the surface of the inker roller may be contacted with a cleaner (disturber) roller at a position downstream in a process direction from the ink transfer nip. The cleaner roller may have a highly conformal surface including a configuration as described above with reference to FIG. 2. The contact of the cleaner roller with the surface of the inker roller may (1) disturb residual ink in cells in the surface of the inker roller and (2) remove residual products, including back-transferred dampening solution, from the surface of the inker roller. Operation of the method proceeds to Step S3600.

In Step S3600, a vacuum may be applied to a hollow core of the cleaner roller to remove residual products through a porous surface of the cleaner roller. Operation of the method proceeds to Step S3700.

In Step S3700, the surface of the cleaner roller may be contacted with at least one distributor roller to aid in removing residual products from the surface of the cleaner roller. Operation the method proceeds to Step S3800, where operation of the method ceases.

The above-described exemplary systems and methods may reference certain conventional lithographic image forming device components to provide a brief, background description of image forming means that may be modified to carry out variable digital data lithographic image forming for images which include, at least in part, advanced surface cleaning and/or conditioning techniques for an inker roller surface, including an anilox inker roller surface, as described in detail above. No particular limitation to a specific configuration of the variable data digital lithography portions or modules of an overall variable data digital lithographic image forming system is to be construed based on the description of the exemplary elements depicted and described above.

Those skilled in the art will appreciate that other embodiments of the disclosed subject matter may be practiced with many types of image forming elements common to lithographic image forming systems in many different configurations. The disclosed systems and methods are directed to a broad configuration of modifications to an inker unit that have been arrived at through exhaustive experimentation and are not intended to imply any potentially limiting configuration based on the above description and the accompanying drawings.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 3, and the accompanying description, except where a particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. An inker unit in a variable data digital lithographic image forming system, comprising:

an ink chamber that provides an ink supply in the inker unit;

an inking member that transfers ink from the ink chamber to an ink transfer nip between the inking member and a reimageable surface of an imaging member, the inking member having at least one of a roughened or pitted surface;

a leveling unit that levels a layer of the ink uniformly on a surface of the inking member;

a cleaner roll having a conformable surface and being positioned to contact the surface of the inking member at a position between the ink transfer nip and the ink chamber, the conformable surface of the cleaner roll having a comparatively low durometer silicone roller surface for penetrating into recesses in the at least one of the roughened or pitted surface of the inking member to disturb residual ink in the recesses that was not completely transferred to the reimageable surface and to engage residual products back transferred from the reimageable surface to the surface of the inking member; and a vacuum system including a vacuum removal component that draws a vacuum through a permeable surface of the cleaner roll and a porous metal roller base formed with a hollowed core to extract at least a portion of the residual products from the surface of the cleaner roll.

2. The inker unit of claim 1, the leveling unit comprising a doctor blade that contacts the surface of the inking member.

3. The hiker unit of claim 1, the inking member being an anilox roller.

4. The hiker unit of claim 1, the residual products including dampening solution on the reimageable surface.

5. The hiker unit of claim 1, the ink chamber having a wiper blade at an entrance of the ink chamber that wipes the residual products from the surface of the inking member.

6. The hiker unit of claim 1, further comprising at least one other roll positioned in contact with the surface of the cleaner roll to lift at least a portion of the residual products from the surface of the cleaner roll.

7. A method for conditioning a surface of an inking member in a variable data digital lithographic image forming system, comprising:

transferring ink from an ink supply chamber to a reimageable surface of an imaging member with an inking member having at least one of a roughened or pitted surface;

leveling a layer of ink uniformly on a surface of the inking member before the inked surface of the inking member contacts the reimageable surface at an ink transfer nip to deposit the ink on the reimageable surface;

contacting the inking member with a cleaner roll having a conformable surface positioned to contact the surface of the inking member at a position between the ink transfer nip and the ink supply chamber, the conformable surface of the cleaner roll having a comparatively low durometer silicone roller surface; and penetrating into recesses in the at least one of the roughened or pitted surface of the inking member with the conformable surface of the cleaner roll to disturb residual ink in the recesses that was not completely transferred to the reimageable surface and to engage residual products back transferred from the reimageable surface to the surface of the inking member; and applying a vacuum to a vacuum removal component that draws a vacuum through a permeable surface of the cleaner roll and a porous metal roller base formed with a hollowed core to extract at least a portion of the residual products from the surface of the cleaner roll.

8. The method of claim 7, leveling being accomplished by contacting the surface of the inking member with a doctor blade.

9. The method of claim 7, the inking member being an anilox roller.

10. The method of claim 7, the residual products including dampening solution on the reimageable surface.

11. The method of claim 7, further comprising wiping the surface of the inking member at an entrance of the ink chamber with a wiper blade to remove the residual products from the surface of the inking member.

12. The method of claim 7, further comprising contacting the surface of the cleaner roll with at least one other roll to lift at least a portion of the residual products from the surface of the cleaner roll.

13. A variable data digital lithographic image forming system, comprising:

a reimageable surface on an imaging member;

a dampening solution source that deposits a layer of dampening solution on the reimageable surface of the imaging member;

an optical source that patterns the layer of the dampening solution on the reimageable surface according to an image input; and an inker unit that inks the patterned reimageable surface, the ink being transferred from the reimageable surface to a substrate at an imaging nip to form an image on the substrate, the inker unit comprising:

an ink chamber that provides an ink supply in the inker unit;

an inking member that transfers ink from the ink chamber to an ink transfer nip between the inking member and the reimageable surface on the imaging member, the inking member having at least one of a roughened or pitted surface;

a leveling unit that levels a layer of the ink uniformly on the surface of the inking member;

a cleaner roll having a conformable surface and being positioned to contact the surface of the inking member at a position between the ink transfer nip and the ink chamber, the conformable surface of the cleaner roll having a comparatively low durometer silicone roller surface for penetrating into recesses in the at least one of the roughened or pitted surface of the inking member to disturb residual ink in the recesses that was not completely transferred to the reimageable surface and to engage residual products back transferred from the reimageable surface to the surface of the inking member; and a vacuum system including a vacuum removal component that draws a vacuum through a permeable surface of the cleaner roll and a porous metal roller base formed with a hollowed core to extract at least a portion of the residual products from the surface of the cleaner roll.

14. The variable data digital lithographic image forming system of claim 13, the inking member being an anilox roller and the leveling unit comprising a doctor blade that contacts the surface of the anilox roller.

15. The variable data digital lithographic image forming system of claim 13, the residual products including the dampening solution on the reimageable surface.

16. The variable data digital lithographic image forming system of claim 13, the ink chamber having a wiper blade at an entrance of the ink chamber that wipes the residual products from the surface of the inking member.

17. The variable data digital lithographic image forming system of claim 13, the inker unit further comprising at least one other roll positioned in contact with the surface of the cleaner roll to lift at least a portion of the residual products from the surface of the cleaner roll.

* * * * *